US011014143B2

(12) United States Patent
Satoh et al.

(10) Patent No.: US 11,014,143 B2
(45) Date of Patent: May 25, 2021

(54) CASTING MOLD, METHOD OF MANUFACTURING SAME, TIAL ALLOY CAST PRODUCT, AND METHOD OF CASTING SAME

(71) Applicant: IHI CORPORATION, Tokyo (JP)

(72) Inventors: Shigeyuki Satoh, Tokyo (JP); Tatsuya Sekiguchi, Tokyo (JP)

(73) Assignee: IHI CORPORATION, Tokyo (JP)

( * ) Notice: Subject to any disclaimer, the term of this patent is extended or adjusted under 35 U.S.C. 154(b) by 1120 days.

(21) Appl. No.: 15/273,442

(22) Filed: Sep. 22, 2016

(65) Prior Publication Data

US 2017/0008073 A1 Jan. 12, 2017

Related U.S. Application Data

(63) Continuation of application No. PCT/JP2015/051967, filed on Jan. 26, 2015.

(30) Foreign Application Priority Data

Mar. 28, 2014 (JP) ..... JP2014-068406

(51) Int. Cl.
*B22C 9/04* (2006.01)
*B22D 21/00* (2006.01)
(Continued)

(52) U.S. Cl.
CPC ..... *B22C 9/043* (2013.01); *B22C 1/00* (2013.01); *B22C 3/00* (2013.01); *B22C 7/02* (2013.01);
(Continued)

(58) Field of Classification Search
CPC ..... B22C 9/04
See application file for complete search history.

(56) References Cited

U.S. PATENT DOCUMENTS 4,844,148 A 7/1989 Cuisin et al.
6,024,163 A 2/2000 Springgate et al.
(Continued)

FOREIGN PATENT DOCUMENTS

CN 1290198 A 4/2001
CN 1863621 A 11/2006
(Continued)

OTHER PUBLICATIONS

Search Report dated Mar. 13, 2017 in corresponding European Patent Application No. 15768629.6 (10 pages).
(Continued)

*Primary Examiner* — Jophy S. Koshy
(74) *Attorney, Agent, or Firm* — Rothwell, Figg, Ernst & Manbeck, P.C.

(57) ABSTRACT

A casting mold to cast a TiAl alloy includes a casting mold body formed into a bottomed shape and provided with a cavity. The casting mold body includes a reaction-resistant layer provided on the cavity side, formed from a refractory material containing at least one of cerium oxide, yttrium oxide, and zirconium oxide and a back-up layer formed on the reaction-resistant layer. The back-up layer includes a weakening layer formed from a refractory material including a silica material in a range from 80% by mass to 100% by mass inclusive, the silica material containing cristobalite in a range from 26% by mass to 34% by mass inclusive and the rest being fused silica, the weakening layer being designed to reduce casting mold strength and a shape-retention layer formed from a refractory material.

5 Claims, 10 Drawing Sheets

(51) Int. Cl.

| | |
|---|---|
| ***C22C 14/00*** | (2006.01) |
| ***B22C 1/00*** | (2006.01) |
| ***B22C 3/00*** | (2006.01) |
| ***B22C 7/02*** | (2006.01) |
| ***B22C 9/12*** | (2006.01) |
| ***B22D 25/02*** | (2006.01) |
| *F01D 5/28* | (2006.01) |

(52) U.S. Cl.

CPC ..... *B22C 9/04* (2013.01); *B22C 9/12* (2013.01); *B22D 21/005* (2013.01); *B22D 25/02* (2013.01); *C22C 14/00* (2013.01); *F01D 5/28* (2013.01); *F05D 2230/21* (2013.01); *F05D 2300/174* (2013.01)

(56) References Cited

U.S. PATENT DOCUMENTS

| | | | | |
|---|---|---|---|---|
| 7,322,795 | B2 * | 1/2008 | Luczak | F01D 5/186 416/91 |
| 2007/0034350 | A1 | 2/2007 | Renkel et al. | |
| 2008/0292804 | A1 | 11/2008 | Bewlay et al. | |
| 2011/0203761 | A1 | 8/2011 | Renkel | |
| 2013/0224066 | A1 | 8/2013 | Bewlay et al. | |

FOREIGN PATENT DOCUMENTS

| | | | |
|---|---|---|---|
| CN | 1895816 | A | 1/2007 |
| CN | 101257985 | A | 9/2008 |
| EP | 0 179 649 | A2 | 4/1986 |
| EP | 1 990 593 | A1 | 11/2008 |
| EP | 2 340 136 | A2 | 7/2011 |
| EP | 2 340 136 | B1 | 1/2013 |
| JP | 61-101430 | A | 5/1986 |
| JP | 64-500020 | A | 1/1989 |
| JP | 9-57392 | A | 3/1997 |
| JP | 10-5928 | A | 1/1998 |
| JP | 2007-69246 | A | 3/2007 |
| JP | 2007-69247 | A | 3/2007 |
| JP | 2007-508146 | A | 4/2007 |
| JP | 2010-188360 | A | 9/2010 |
| JP | 2011-255398 | A | 12/2011 |
| JP | 2012-503553 | A | 2/2012 |
| JP | 2013-180344 | A | 9/2013 |
| WO | 99/41030 | A1 | 8/1999 |
| WO | 2010/034765 | A2 | 4/2010 |

OTHER PUBLICATIONS

International Search Report dated Apr. 28, 2015 in PCT/JP2015/051967 (4 pages).

* cited by examiner

CASTING MOLD, METHOD OF MANUFACTURING SAME, TIAL ALLOY CAST PRODUCT, AND METHOD OF CASTING SAME

CROSS REFERENCE TO RELATED APPLICATIONS

This application is a continuation application of International Application No. PCT/JP2015/051967, filed on Jan. 26, 2015, which claims priority to Japanese Patent Application No. 2014-068406, filed on Mar. 28, 2014, the entire contents of which are incorporated by references herein.

BACKGROUND

1. Field

The present disclosure relates to a casting mold, a method of manufacturing the same, a TiAl alloy cast product, and a method of casting the same. More specifically, the present disclosure relates to a casting mold to cast a TiAl (titanium aluminide) alloy, a method of manufacturing the same, a TiAl alloy cast product, and a method of casting the same.

2. Description of the Related Art

A TiAl alloy which is an intermetallic compound of titanium and aluminum has excellent properties such as specific strength in a high-temperature range, and is therefore applied to products such as a turbine blade of a jet engine. A casting mold used for casting the turbine blade or the like made of the TiAl alloy is the same as a casting mold to cast a titanium alloy.

Japanese Patent Application Publication No. 2007-69246 (Patent Literature 1) describes a casting mold for a titanium alloy in which at least a first layer of a cavity surface of a casting mold body constituting the casting mold is formed from a burned product of slurry that includes an aggregate mainly composed of cerium oxide and binder mainly composed of at least zirconia sol.

SUMMARY

Meanwhile, a TiAl alloy is an intermetallic compound and is therefore a brittle material. Accordingly, a TiAl alloy cast product may cause fractures or cracks due to its shrinkage in a cooling process (from 1100° C. to 1000° C.) after the casting. To be more precise, at the time of cooling after the casting, the casting mold restrains the TiAl alloy cast product and applies a tensile stress to the TiAl alloy cast product because an amount of shrinkage of the TiAl alloy cast product becomes larger than an amount of shrinkage of the casting mold due to a difference in thermal expansion between the TiAl alloy cast product and the casting mold. As a consequence, the TiAl alloy cast product is likely to cause fractures or cracks.

Accordingly, an object of the present disclosure is to provide a casting mold, a method of manufacturing the same, a TiAl alloy cast product, and a method of casting the same, which are capable of suppressing fractures or cracks in a TiAl alloy cast product.

A casting mold according to the disclosure is a casting mold to cast a TiAl alloy, including a casting mold body formed into a bottomed shape and provided with a cavity into which a molten TiAl alloy is to be poured, wherein the casting mold body includes a reaction-resistant layer provided on the cavity side, formed from a refractory material containing at least one of cerium oxide, yttrium oxide, and zirconium oxide, and configured to suppress a reaction with the molten TiAl alloy, and a back-up layer formed on the reaction-resistant layer, and the back-up layer includes a weakening layer formed from a refractory material including a silica material in a range from 80% by mass to 100% by mass inclusive, the silica material containing cristobalite in a range from 26% by mass to 34% by mass inclusive and the rest being fused silica, the weakening layer being designed to reduce casting mold strength, and a shape-retention layer formed from a refractory material and designed to retain a casting mold shape.

The casting mold according to the disclosure, wherein the refractory material forming the weakening layer includes the silica material in a range from 90% by mass to 100% by mass inclusive.

The casting mold according to the disclosure, wherein the refractory material forming the weakening layer consists of the silica material.

The casting mold according to the disclosure, wherein the weakening layer is formed directly on the reaction-resistant layer.

A method of manufacturing a casting mold according to the disclosure is a method of manufacturing a casting mold to cast a TiAl alloy, including a wax pattern shaping step of shaping a wax pattern model for forming a casting mold body, the casting mold body being formed into a bottomed shape and provided with a cavity into which a molten TiAl alloy is to be poured, a reaction-resistant slurry layer forming step of forming a reaction-resistant slurry layer by coating the wax pattern model with reaction-resistant slurry formed by mixing refractory particles including at least one of cerium oxide, yttrium oxide, and zirconium oxide, with binder, and performing stucco processing with a reaction-resistant stucco material formed from refractory particles including at least one of cerium oxide, yttrium oxide, and zirconium oxide, a back-up slurry layer forming step of forming a back-up slurry layer on the reaction-resistant slurry layer, a dewaxing step of shaping a casting mold compact by heating and dewaxing the wax pattern model provided with the reaction-resistant slurry layer and the back-up slurry layer and a burning step of heating and burning the casting mold compact at a temperature in a range from 1000° C. to 1100° C. inclusive, wherein the back-up slurry layer is formed in the back-up slurry layer forming step by forming a weakening slurry layer by coating weakening slurry, which is formed by mixing refractory particles including fused silica in a range from 80% by mass to 100% by mass inclusive, with binder, and performing stucco processing with a weakening stucco material formed from refractory particles including fused silica in a range from 80% by mass to 100% by mass inclusive, and forming a shape-retention slurry layer by providing shape-retention slurry, which is formed by mixing refractory particles with binder, and performing stucco processing with a shape-retention stucco material formed from refractory particles.

The method of manufacturing a casting mold according to the disclosure, wherein the weakening slurry layer is formed in the back-up slurry layer forming step by coating the weakening slurry, which is formed by mixing the refractory particles including fused silica in a range from 90% by mass to 100% by mass inclusive, with the binder, and performing the stucco processing with the weakening stucco material formed from the refractory particles including fused silica in a range from 90% by mass to 100% by mass inclusive.

The method of manufacturing a casting mold according to the disclosure, wherein the weakening slurry layer is formed in the back-up slurry layer forming step by coating the weakening slurry, which is formed by mixing the refractory particles consisting of fused silica, with the binder, and performing the stucco processing with the weakening stucco material formed from the refractory particles consisting of fused silica.

The method of manufacturing a casting mold according to the disclosure, wherein the weakening slurry layer is formed directly on the reaction-resistant slurry layer in the back-up slurry layer forming step.

A TiAl alloy cast product cast with the casting mold according to the disclosure.

A method of casting a TiAl alloy cast product according to the disclosure including the steps of heating the casting mold according to the disclosure to a range from 1100° C. to 1300° C. and performing casting by pouring a molten TiAl alloy into the casting mold.

According to the above-described configurations, since the casting mold to cast a TiAl alloy is provided with the weakening layer to reduce the casting mold strength, cracks on the casting mold occur in the weakening layer in a cooling process (from 1100° C. to 1000° C.) after the casting. As a consequence, a TiAl alloy cast product is released from restraint of the casting mold, and fractures or cracks in the TiAl alloy cast product can thus be suppressed.

DESCRIPTION OF EMBODIMENTS

Figure 1:
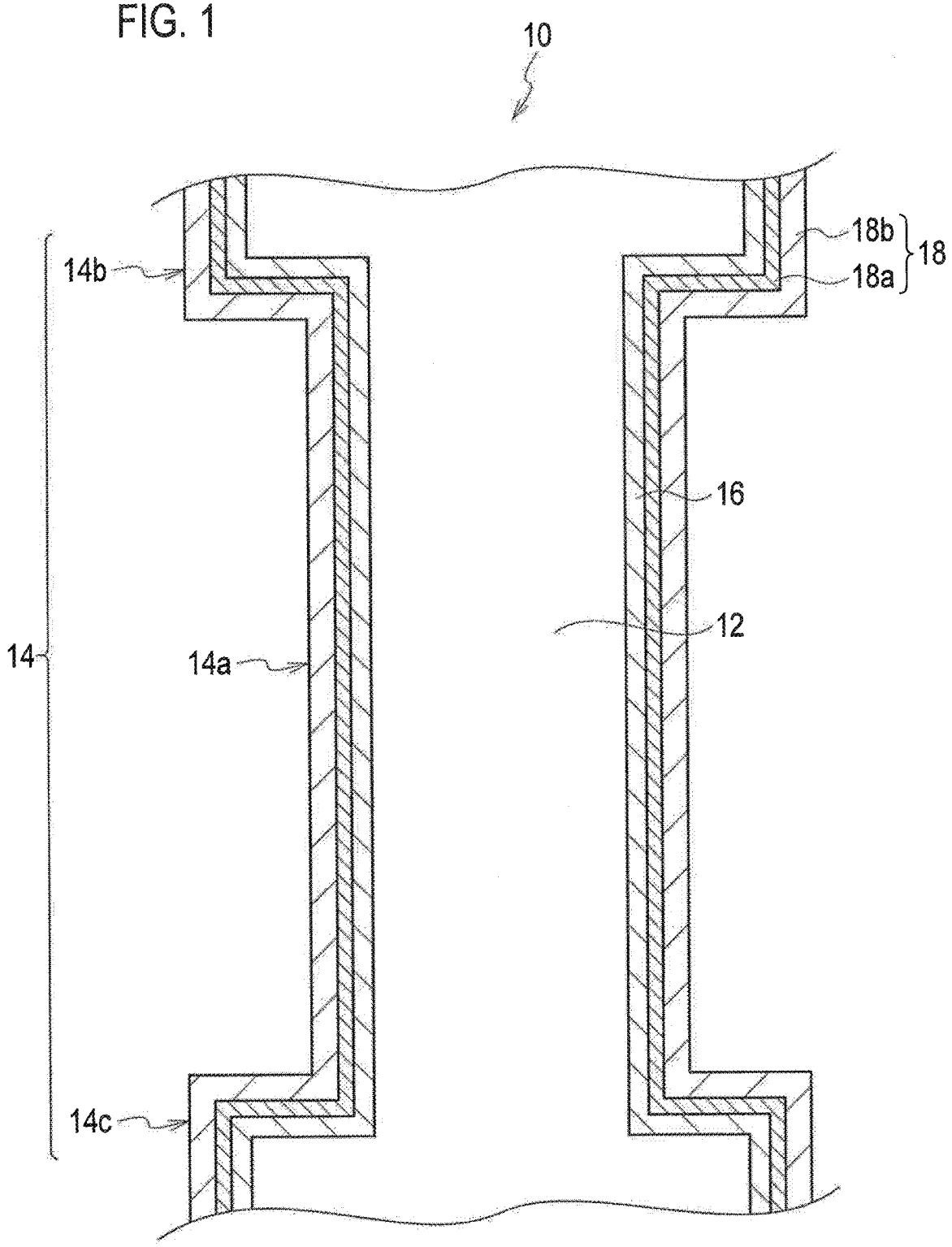
FIG. 1 is a cross-sectional view showing a configuration of a casting mold to cast a TiAl alloy in an embodiment of the present disclosure.

An embodiment of the present disclosure will be described below in detail with reference to the drawings. FIG. 1 is a cross-sectional view showing a configuration of a casting mold 10 to cast a TiAl alloy. The casting mold 10 shown in FIG. 1 is a casting mold to cast a turbine blade as a TiAl alloy cast product.

The casting mold 10 includes a casting mold body 14 formed into a bottomed shape and provided with a cavity 12 into which a molten TiAl alloy is to be poured. The casting mold body 14 includes a blade body casting portion 14*a* to cast a blade body, a shroud casting portion 14*b* to cast a shroud, and a platform casting portion 14*c* to cast a platform. The casting mold body 14 is provided with a sprue (not shown) used for pouring the molten TiAl alloy into the empty cavity 12.

The casting mold body 14 includes a reaction-resistant layer 16, which is provided on the cavity side and designed to suppress a reaction with the molten TiAl alloy. The reaction-resistant layer 16 is formed from a refractory material, which is made of an oxide and the like having low reactivity with the molten TiAl alloy. The refractory material for the reaction-resistant layer 16 contains at least one of cerium oxide ($CeO_2$), yttrium oxide ($Y_2O_3$), and zirconium oxide ($ZrO_2$). The refractory material for the reaction-resistant layer 16 may use one of these oxides alone or use a combination of these oxides. A thickness of the reaction-resistant layer 16 is in a range from 0.5 mm to 2.0 mm, for example.

Cerium oxide which has lower reactivity with the molten TiAl alloy than that of zirconium oxide and is also inexpensive may be used as a main component of the refractory material for the reaction-resistant layer 16. By using cerium oxide, it is possible to inhibit the TiAl alloy cast product from burning to the casting mold 10 and thus to improve surface smoothness of the TiAl alloy cast product.

The casting mold body 14 includes a back-up layer 18 which is made of a refractory material and is formed on the reaction-resistant layer 16. The back-up layer 18 is formed from a weakening layer 18*a* to reduce casting mold strength, and a shape-retention layer 18*b* to retain a casting mold shape.

The weakening layer 18*a* is formed from a refractory material which includes a silica material in a range from 80% by mass to 100% by mass inclusive. Here, the silica material contains cristobalite in a range from 26% by mass to 34% by mass inclusive, and the rest is fused silica. A thickness of the weakening layer 18*a* is in a range from 0.5 mm to 2.0 mm, for example.

The silica material included in the refractory material that forms the weakening layer 18*a* contains cristobalite. Cristobalite has a phase transformation between β-type (β-cristobalite) and α-type (α-cristobalite) in a temperature range from 200° C. to 300° C. This phase transformation brings about a change in volume and causes cracks (microcracks) in the weakening layer 18*a*. Thus, the casting mold strength can be reduced.

A rate of the amount of cristobalite in the silica material is in the range from 26% by mass to the 34% by mass inclusive, or may be equal to 34% by mass due to the following reason. Specifically, if the rate of the amount of cristobalite in the silica material is below 26% by mass, the cracks (the microcracks) in the weakening layer 18*a* are reduced and high-temperature strength of the casting mold 10 in a cooling process (from 1100° C. to 1000° C.) after the casting is increased as a consequence. On the other hand, when the rate of the amount of cristobalite in the silica material is equal to 34% by mass, the cracks (the microcracks) in the weakening layer 18*a* are increased to reach a sufficient amount for reducing the strength of the casting mold 10 in the cooling process (from 1100° C. to 1000° C.) after the casting.

A reason why the content rate of the silica material included in the refractory material is set equal to or above 80% by mass is that the high-temperature strength in the range from 1000° C. to 1100° C. of the casting mold 10 is increased if the content rate of the silica material is below 80% by mass. The weakening layer 18*a* may be formed from a refractory material which includes the above-described silica material (which contains cristobalite in the range from 26% by mass to 34% by mass inclusive while the rest is fused silica), in a range from 90% by mass to 100% by mass inclusive. In this case, the high-temperature strength in the range from 1000° C. to 1100° C. of the casting mold 10 can further be reduced. Alternatively, the refractory material forming the weakening layer 18*a* may consist of the above-described silica material (100% by mass of the silica material which contains cristobalite in the range from 26% by mass to 34% by mass inclusive while the rest is fused silica).

At least one of oxides including zirconium silicate ($ZrSiO_4$), aluminum oxide ($Al_2O_3$), zirconium oxide ($ZrO_2$) magnesium oxide (MgO), mullite ($Al_6Si_2O_{13}$), and the like can be used in the rest of the refractory material that forms the weakening layer 18*a*.

Oxides including zirconium silicate ($ZrSiO_4$), silicon dioxide ($SiO_2$), aluminum oxide ($Al_2O_3$), mullite ($Al_6Si_2O_{13}$), and the like can be used in a refractory material for the shape-retention layer 18*b*. The refractory material for the shape-retention layer 18*b* may use one of these oxides alone or use a combination of these oxides. A thickness of the shape-retention layer 18*b* is in a range from 0.5 mm to 5.0 mm, for example.

Regarding the formation of the back-up layer 18, the weakening layer 18*a* may be formed directly on the reaction-resistant layer 16 and then the shape-retention layer 18*b* may be formed on the weakening layer 18*a*, or the shape-retention layer 18*b* may be formed directly on the reaction-resistant layer 16 and then the weakening layer 18*a* may be formed on the shape-retention layer 18*b*. Meanwhile, the back-up layer 18 may be constructed by alternately forming the weakening layers 18*a* and the shape-retention layers 18*b*.

The weakening layer 18*a* may be formed directly on the reaction-resistant layer 16 because the casting mold 10 is more likely to cause cracks by providing the weakening layer 18*a* closer to the TiAl alloy cast product.

Next, a method of manufacturing the casting mold 10 to cast a TiAl alloy will be described.

Figure 2:
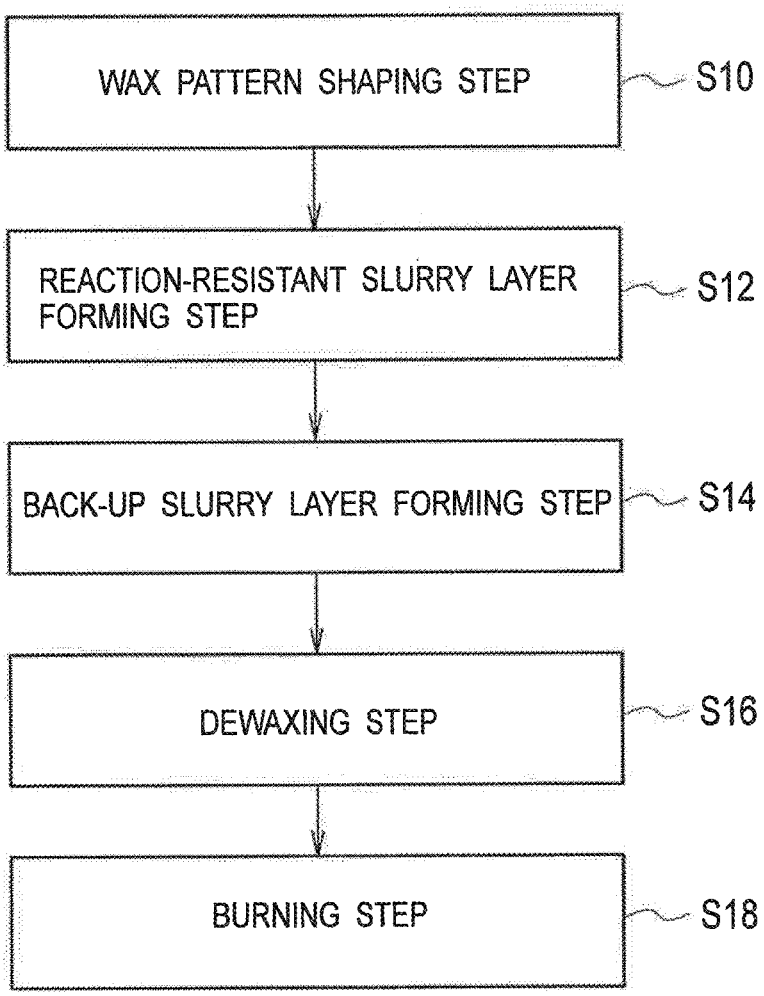
FIG. 2 is a flowchart showing a method of manufacturing the casting mold to cast a TiAl alloy in the embodiment of the present disclosure.

FIG. 2 is a flowchart showing the method of manufacturing the casting mold 10 to cast a TiAl alloy. The method of manufacturing the casting mold 10 to cast a TiAl alloy includes a wax pattern shaping step (S10), a reaction-resistant slurry layer forming step (S12), a back-up slurry layer forming step (S14), a dewaxing step (S16), and a burning step (S18).

Figure 3A:
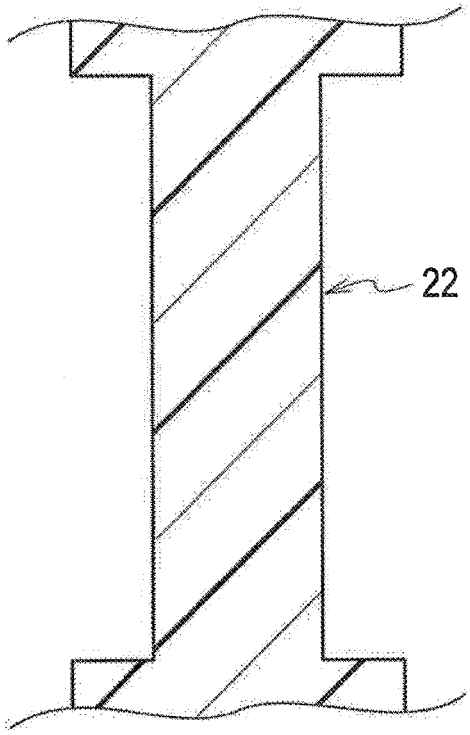
FIG. 3A is a cross-sectional view for explaining the wax pattern shaping step in the method of manufacturing the casting mold to cast a TiAl alloy in the embodiment of the present disclosure.
Figure 3B:
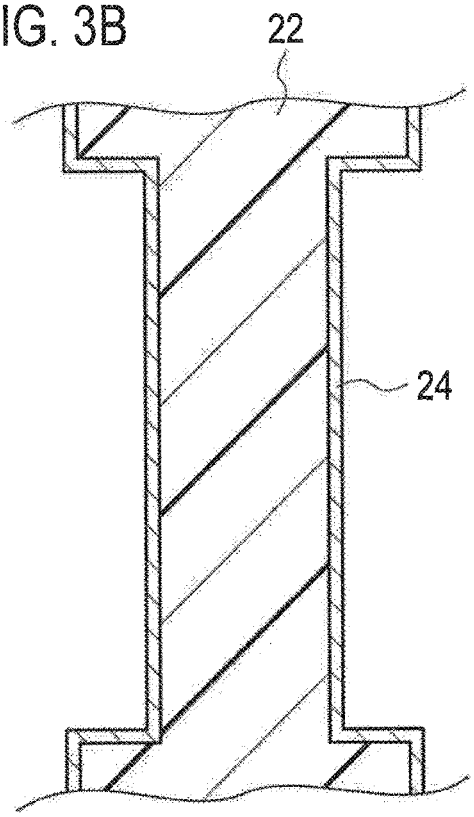
FIG. 3B is a cross-sectional view for explaining the reaction-resistant slurry layer forming step in the method of manufacturing the casting mold to cast a TiAl alloy in the embodiment of the present disclosure.
Figure 3C:
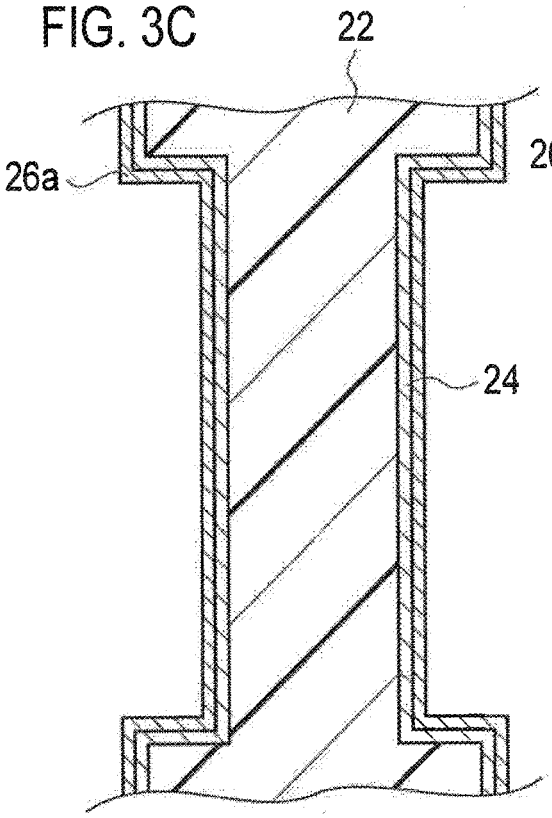
FIG. 3C is cross-sectional view for explaining the back-up slurry layer forming step in the method of manufacturing the casting mold to cast a TiAl alloy in the embodiment of the present disclosure.
Figure 3D:
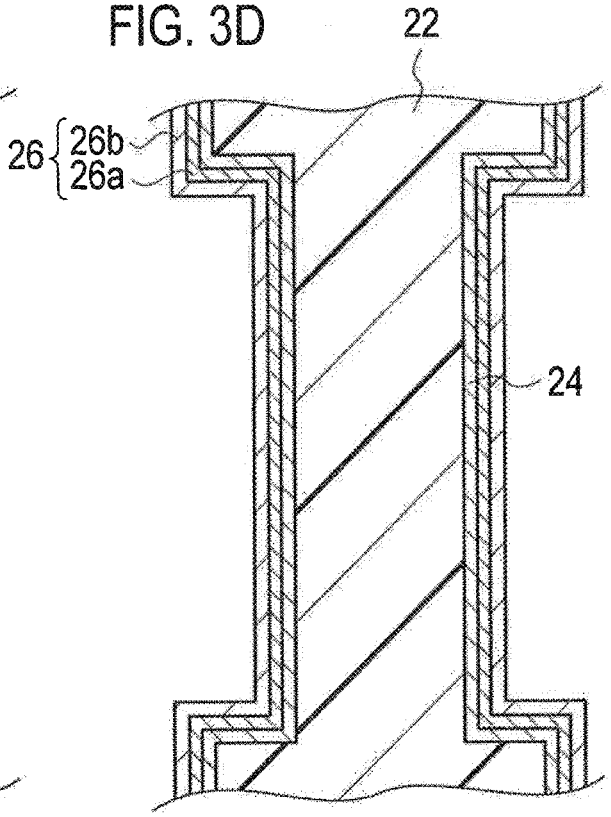
FIG. 3D is cross-sectional view for explaining the back-up slurry layer forming step in the method of manufacturing the casting mold to cast a TiAl alloy in the embodiment of the present disclosure.

FIGS. 3A, 3B, 3C, and 3D include cross-sectional views for explaining the respective steps in the method of manufacturing the casting mold 10 to cast a TiAl alloy, in which FIG. 3A is a cross-sectional view for explaining the wax pattern shaping step (S10), FIG. 3B is a cross-sectional view for explaining the reaction-resistant slurry layer forming step (S12), and FIG. 3C and FIG. 3D are cross-sectional views for explaining the back-up slurry layer forming step (S14).

As shown in FIG. 3A, the wax pattern shaping step (S10) is a step of shaping a wax pattern model 22 for forming the casting mold body 14 that is formed into a bottomed shape and provided with the cavity 12 into which the molten TiAl alloy is to be poured. The wax pattern model 22 for forming the casting mold body 14 is shaped by using a wax material. The wax pattern model 22 is shaped by pouring the wax material into a mold by injection molding and the like, then curing the wax material, and taking the wax material out of the mold.

As shown in FIG. 3B, the reaction-resistant slurry layer forming step (S12) is a step of forming a reaction-resistant slurry layer 24 by coating the wax pattern model 22 with reaction-resistant slurry formed by mixing refractory particles including at least one of cerium oxide, yttrium oxide, and zirconium oxide, with binder and performing stucco processing with a reaction-resistant stucco material formed from refractory particles including at least one of cerium oxide, yttrium oxide, and zirconium oxide.

First, the reaction-resistant slurry is coated on the wax pattern model 22. The reaction-resistant slurry includes the refractory particles having low reactivity with the molten TiAl alloy, and the binder. Refractory particles including at least one of cerium oxide, yttrium oxide, and zirconium oxide are used as the refractory particles of the reaction-resistant slurry. The refractory particles of the reaction-resistant slurry may use one of these oxides alone or use a combination of these oxides. Meanwhile, refractory particles of #325 mesh size, for example, can be used as the refractory particles of the reaction-resistant slurry.

Materials including silica sol such as colloidal silica, zirconia sol, yttria sol, and organic binder such as phenol resin can be used as the binder. The binder may use one of these materials alone or use a combination of these materials. Meanwhile, when silica sol is used as the binder, cerium oxide as the refractory particles in order to suppress a reaction between the molten TiAl alloy and silica sol may be used.

A dipping method, a spraying method, and an applying method can be used as a method of coating the reaction-resistant slurry. Nonetheless, the dipping method may be used because this method can achieve uniform coating on the wax pattern model 22.

Next, the wax pattern model 22 coated with the reaction-resistant slurry is subjected to stucco processing with the reaction-resistant stucco material and is then dried. Refractory particles including at least one of cerium oxide, yttrium oxide, and zirconium oxide in a range from #60 mesh size to #160 mesh size, for example, are used as the reaction-resistant stucco material. As described above, the wax pattern model 22 is subjected to the coating of the reaction-resistant slurry and the stucco processing with the reaction-resistant stucco material, and the reaction-resistant slurry layer 24 is thus formed on the wax pattern model 22. Here, the coating of the reaction-resistant slurry and the stucco processing with the reaction-resistant stucco material may be repeated several times in order to form the reaction-resistant slurry layer 24 into a prescribed thickness.

As shown in FIG. 3C and FIG. 3D, the back-up slurry layer forming step (S14) is a step of forming a back-up slurry layer 26 on the reaction-resistant slurry layer 24. The back-up slurry layer 26 including a weakening slurry layer 26*a* and a shape-retention slurry layer 26*b* is formed on the reaction-resistant slurry layer 24.

First, as shown in FIG. 3C, weakening slurry is coated on the reaction-resistant slurry layer 24. The weakening slurry is formed by mixing refractory particles, which contain fused silica in a range from 80% by mass to 100% by mass inclusive, with binder. The refractory particles constituting the weakening slurry may include fused silica in a range from 90% by mass to 100% by mass inclusive. Alternatively, the refractory particles constituting the weakening slurry may consist of fused silica (100% by mass of fused silica).

At least one of oxides including zirconium silicate ($ZrSiO_4$), aluminum oxide ($Al_2O_3$), zirconium oxide ($ZrO_2$) magnesium oxide (MgO), mullite ($Al_6Si_2O_{13}$), and the like can be used in the rest of the refractory particles constituting the weakening slurry. Here, refractory particles of #325 mesh size, for example, can be used as the refractory particles of the weakening slurry. As for the binder therein, the binder such as silica sol as in the reaction-resistant slurry can be used. Here, silica sol such as colloidal silica may be used.

Next, a surface coated with the weakening slurry is subjected to stucco processing with a weakening stucco material, and then the processed surface is dried. Refractory particles containing fused silica in a range from 80% by mass to 100% by mass inclusive are used in the weakening stucco material. Refractory particles containing fused silica in a range from 90% by mass to 100% by mass inclusive may be used in the weakening stucco material. Alternatively, the refractory particles constituting the weakening stucco material may consist of fused silica (100% by mass of fused silica) Refractory particles such as zirconium silicate ($ZrSiO_4$), aluminum oxide ($Al_2O_3$), zirconium oxide ($ZrO_2$), magnesium oxide (MgO), and mullite ($Al_6Si_2O_{13}$) can be used in the rest of the refractory particles constituting the weakening stucco material. Here, refractory particles in a range from #60 mesh size to #160 mesh size, for example, can be used as the refractory particles of the weakening stucco material.

The coating of the weakening slurry and the stucco processing with the weakening stucco material may be repeated twice to five times, for example, until the weakening slurry layer 26*a* reaches a prescribed thickness.

Next, as shown in FIG. 3D, shape-retention slurry is coated on the weakening slurry layer 26*a*. The shape-retention slurry is formed by mixing refractory particles with binder. At least one of oxides including zirconium silicate ($zrSiO_4$) silicon dioxide ($SiO_2$), aluminum oxide ($Al_2O_3$), mullite ($Al_6Si_2O_{13}$), and the like can be used as the refractory particles of the shape-retention slurry. Binder such as silica sol as in the reaction-resistant slurry can be used as the binder. Here, refractory particles of #325 mesh size, for example, can be used as the refractory particles of the shape-retention slurry.

Next, a surface coated with the shape-retention slurry is subjected to stucco processing with a shape-retention stucco material, and then the processed surface is dried. Refractory particles of at least one of oxides including zirconium silicate ($ZrSiO_4$), silicon dioxide ($SiO_2$), aluminum oxide ($Al_2O_3$), mullite ($Al_6Si_2O_{13}$) and the like can be used as the shape-retention stucco material. Here, refractory particles in a range from #60 mesh size to #160 mesh size, for example, can be used as the refractory particles of the shape-retention stucco material. The coating of the shape-retention slurry and the stucco processing with the shape-retention stucco material may be repeated twice to five times, for example, until the shape-retention slurry layer 26*b* reaches a prescribed thickness.

Thus, the back-up slurry layer 26 including the weakening slurry layer 26*a* and the shape-retention slurry layer 26*b* is formed on the reaction-resistant slurry layer 24. Regarding the formation of the back-up slurry layer 26, the weakening slurry layer 26*a* may be formed directly on the reaction-resistant slurry layer 24 and then the shape-retention slurry layer 26*b* may be formed on the weakening slurry layer 26*a*, or the shape-retention slurry layer 26*b* may be formed directly on the reaction-resistant slurry layer 24 and then the weakening slurry layer 26*a* may be formed on the shape-retention slurry layer 26*b*. Meanwhile, the back-up slurry layer 26 may be constructed by alternately forming the weakening slurry layers 26*a* and the shape-retention slurry layers 26*b*. Here, the weakening slurry layer 26*a* may be formed directly on the reaction-resistant slurry layer 24 in order to form the weakening layer 18*a* directly on the reaction-resistant layer 16.

The dewaxing step (S16) is a step of shaping a casting mold compact by heating and dewaxing the wax pattern model 22 provided with the reaction-resistant slurry layer 24 and the back-up slurry layer 26. The casting mold compact is shaped by melting and thus removing the wax pattern model 22. The dewaxing is conducted by putting the wax pattern model 22 provided with the reaction-resistant slurry layer 24 and the back-up slurry layer 26 into an autoclave or the like, and subjecting the wax pattern model 22 to a heat and pressure treatment at a temperature in a range from 100° C. to 180° C. and a pressure in a range from 4 atm (0.4 MPa) to 8 atm (0.8 MPa). As a consequence of this dewaxing process, the wax pattern model 22 is eluted and the casting mold compact (a green compact) is obtained.

The burning step (S18) is a step of heating and burning the casting mold compact at a burning temperature in a range from 1000° C. to 1100° C. inclusive. By heating and burning the casting mold compact in the range from 1000° C. to 1100° C. in a burning furnace or the like, the reaction-resistant slurry layer 24 is sintered into the reaction-resistant layer 16, while the back-up slurry layer 26 including the weakening slurry layer 26*a* and the shape-retention slurry layer 26*b* is sintered into the back-up layer 18 including the weakening layer 18*a* and the shape-retention layer 18*b*. Thus, the casting mold compact becomes a shell that forms the casting mold 10. The cavity 12 is formed at a position from which the wax pattern model 22 is eluted. A burning period is set in a range from one hour to ten hours, for example.

In the course of being cooled down to a room temperature after having been heated at the burning temperature in the range from 1000° C. to 1100° C. inclusive, cristobalite produced from fused silica contained in the weakening slurry layer 26*a* has the phase transformation from the β-type (β-cristobalite) to the α-type (α-cristobalite), which brings about the change in volume and causes the cracks (the microcracks) in the weakening layer 18*a*. Thus, the strength of the weakening layer 18*a* can be reduced. Here, the cooling after the heating may take the form of furnace cooling or air cooling. However, the air cooling brings about more cracks (the microcracks) in the weakening layer 18*a*.

Moreover, when the burning temperature is in the range from 1000° C. to 1100° C. inclusive, the rate of the amount of cristobalite in the silica material formed from fused silica and cristobalite falls in the range from 26% by mass to the 34% by mass inclusive.

A reason why the burning temperature is equal to or above 1000° C. is described below. Specifically, if the burning temperature is below 1000° C., the rate of the amount of cristobalite in the silica material contained in the weakening layer 18*a* falls below 26% by mass, whereby the cracks (the microcracks) occurring in the weakening layer 18*a* are reduced and the casting mold strength is increased.

A reason why the burning temperature is equal to or below 1100° C. is described below. Specifically, if the burning temperature is equal to 1100° C., then the rate of the amount of cristobalite in the silica material contained in the weakening layer 18*a* is equal to 34% by mass, whereby the cracks (the microcracks) can be sufficiently brought about in the weakening layer 18*a* and the casting mold strength can be reduced. Another reason is that production efficiency drops if the burning temperature is higher than 1100° C. Here, the burning temperature may be equal to 1100° C.

Next, a method of casting a TiAl alloy cast product by using the casting mold 10 will be described.

The TiAl alloy put into a melting crucible in a melting chamber of a melting furnace is melted in vacuum, and the molten TiAl alloy is held at a prescribed temperature. The casting mold 10 preheated to a prescribed temperature is put into a casting mold chamber of the melting furnace and is evacuated. The casting mold temperature may be in a range from 1100° C. to 1300° C. If the casting mold temperature is below 1100° C., a casting defect is likely to occur due to misrun and the like. If the casting mold temperature is higher than 1300° C., crystal grain coarsening is likely to occur. When the casting mold chamber reaches a vacuum atmosphere equivalent to that of the melting chamber, a gate valve between the casting mold chamber and the melting chamber is opened and the casting mold 10 is moved into the melting chamber. The molten TiAl alloy is poured into the casting mold while tilting the melting crucible. A casting temperature may be set in a range from 30° C. above to 160° C. above the melting point of the TiAl alloy. When the casting temperature is lower than the temperature that is 30° C. above the melting point of the TiAl alloy, a casting defect is likely to occur due to misrun and the like. When the casting temperature is higher than the temperature that is 160° C. above the melting point of the TiAl alloy, the heating may be difficult due to restrictions of a casting facility and the like, or crystal grain coarsening is likely to occur.

Next, the casting mold 10 into which the molten TiAl alloy is poured is moved to the casting mold chamber and then the gate valve is closed. The casting mold 10 moved to the casting mold chamber is let stand for a predetermined time period in vacuum. Having let the casting mold 10 stand, the casting mold chamber is opened to the atmosphere. Then, the casting mold 10 in which the TiAl alloy is cast is taken out. The casting mold 10 is loaded on a wagon and is let stand until the casting mold 10 is cooled down to a room temperature.

Figure 4:
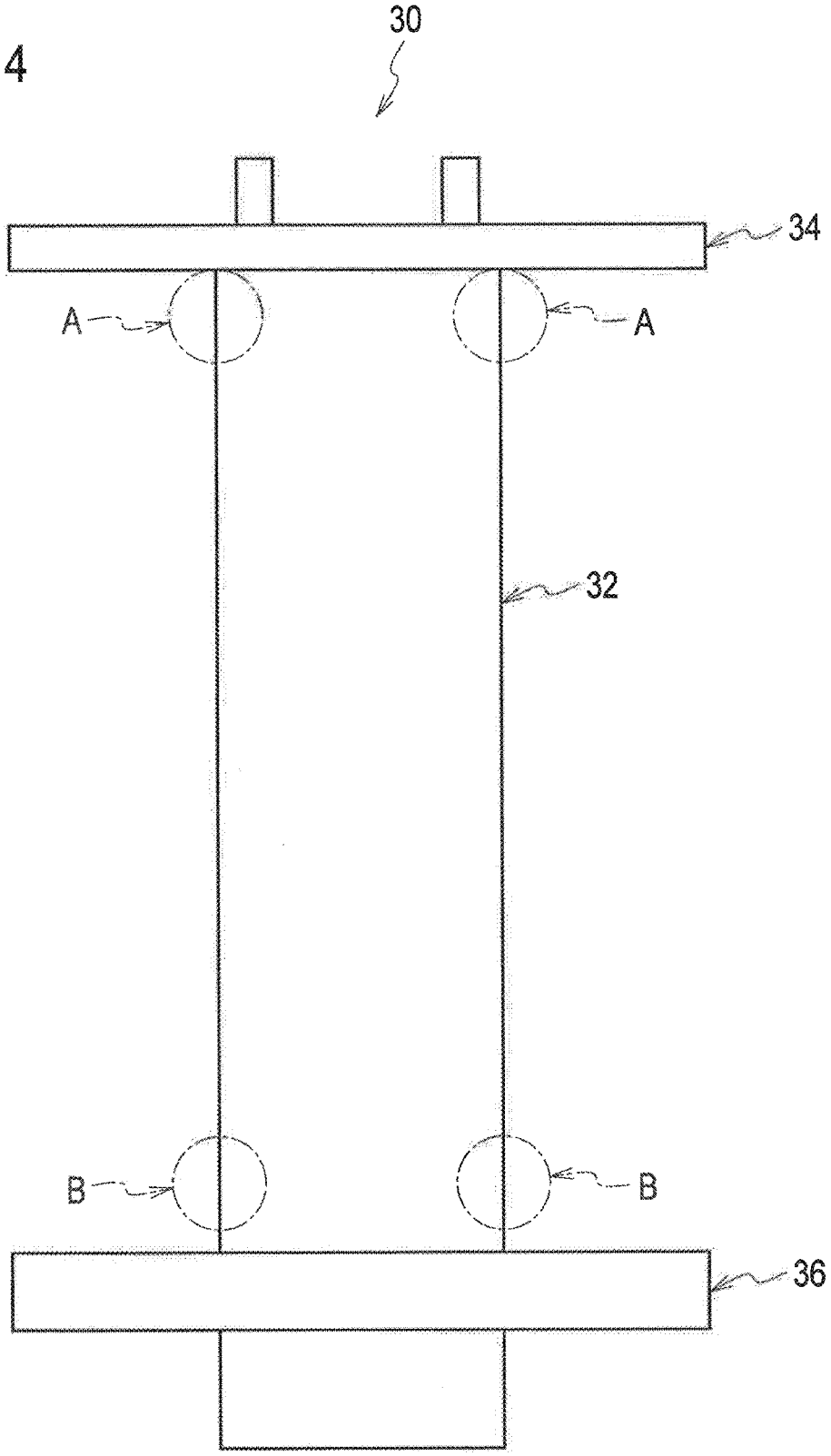
FIG. 4 is a diagram showing a configuration of a turbine blade which is a TiAl alloy cast product in the embodiment of the present disclosure.

FIG. 4 is a diagram showing a configuration of a turbine blade 30 which is the TiAl alloy cast product. The turbine blade 30 is formed from a blade body 32, a shroud 34, and a platform 36. As for the size of the turbine blade 30, a length in its longitudinal direction is from 200 mm to 300 mm, a length in its width direction is from 50 mm to 70 mm, and its thickness is from 3 mm to 7 mm, for example. When the turbine blade 30 is cast with the TiAl alloy being a brittle material, the turbine blade 30 is restrained by the casting mold in a cooling process (from 1100° C. to 1000° C.) after the casting, and a tensile stress is applied to the turbine blade 30 in the longitudinal direction thereof. Accordingly, in the case of using a conventional casting mold, fractures or cracks are likely to occur in a region A between the blade body 32 and the shroud 34 or in a region B between the blade body 32 and the platform 36.

Meanwhile, when the casting mold 10 is provided with the weakening layer 18*a*, an amount of shrinkage of the turbine blade 30 becomes larger than an amount of shrinkage of the casting mold 10, and a compressive stress is applied to the casting mold 10 at the time of shrinkage of the turbine blade 30, whereby cracks occur from the weakening layer 18*a* of the casting mold 10. Thus, the turbine blade 30 is released from the restraint of the casting mold 10, and fractures or cracks in the turbine blade 30 can be suppressed.

According to the above-described configuration, since the casting mold includes the weakening layer with the reduced casting mold strength, cracks occur from the weakening layer of the casting mold in the cooling process (from 1100° C. to 1000° C.) after casting the molten TiAl alloy. Thus, the TiAl alloy cast product is released from the restraint of the casting mold, and fractures or cracks in the TiAl alloy cast product are suppressed.

EXAMPLES

Turbine blades made of a TiAl alloy were cast and occurrence of cracks therein was evaluated. First, high-temperature strength characteristics of molds were evaluated.

(Manufacturing of Molds)

Methods of manufacturing casting molds of Examples 1 to 6 will be described. Note that proportions of fused silica contained in refractory particles of weakening slurry and weakening stucco materials are different among the methods of manufacturing the casting molds of Examples 1 to 3. Meanwhile, thicknesses of the weakening slurry layers are different among the methods of manufacturing the casting molds of Examples 4 to 6. Now, the respective methods of manufacturing the casting molds will be described below in detail.

In the casting molds of Examples 1 to 6, each of the casting molds was provided with the two-layered reaction-resistant slurry layer by repeating the coating of the reaction-resistant slurry and the stucco processing with the reaction-resistant stucco material twice on the wax pattern model. Slurry formed by mixing cerium oxide particles with colloidal silica was used as the reaction-resistant slurry. Cerium oxide particles were used as the reaction-resistant stucco material. The cerium oxide particles of #325 mesh size were used in the reaction-resistant slurry while the cerium oxide particles of #100 mesh size were used in the reaction resistant stucco material.

The weakening slurry layer was formed on the reaction-resistant slurry by performing the coating of the weakening slurry and the stucco processing with the weakening stucco material thereon.

The weakening slurry formed by mixing the refractory particles consisting of fused silica particles (100% by mass of the fused silica particles) with colloidal silica was used in the casting mold of Example 1. The weakening slurry formed by mixing the refractory particles containing 90% by mass of the fused silica particles and 10% by mass of zirconium silicate particles with colloidal silica was used in the casting mold of Example 2. The weakening slurry formed by mixing the refractory particles containing 80% by mass of the fused silica particles and 20% by mass of the zirconium silicate particles with colloidal silica was used in the casting mold of Example 3. The same weakening slurry as that for the casting mold of Example 1 was used in the casting molds of Examples 4 to 6. The refractory particles of #325 mesh size were used in the weakening slurry.

The weakening stucco material consisting of fused silica particles (100% by mass of the fused silica particles) was used in the casting mold of Example 1. The weakening stucco material containing 90% by mass of the fused silica particles and 10% by mass of the zirconium silicate particles was used in the casting mold of Example 2. The weakening stucco material containing 80% by mass of the fused silica particles and 20% by mass of the zirconium silicate particles was used in the casting mold of Example 3. The same weakening stucco material as that for the casting mold of Example 1 was used in the casting molds of Examples 4 to 6. The refractory particles of #100 mesh size were used in each weakening stucco material.

In each of the casting molds of Examples 1 to 3, the two-layered weakening slurry layer was formed on the reaction-resistant slurry layer by repeating the coating of the weakening slurry and the stucco processing with the weakening stucco material twice. In the casting mold of Example 4, the single-layered weakening slurry layer was formed on the reaction-resistant slurry layer by performing the coating of the weakening slurry and the stucco processing with the weakening stucco material once. In the casting mold of Example 5, the three-layered weakening slurry layer was formed on the reaction-resistant slurry layer by repeating the coating of the weakening slurry and the stucco processing with the weakening stucco material three times. In the casting mold of Example 6, the five-layered weakening slurry layer was formed on the reaction-resistant slurry layer by repeating the coating of the weakening slurry and the stucco processing with the weakening stucco material five times.

Next, the shape-retention slurry layer was formed on the weakening slurry layer by performing the coating of the shape-retention slurry and the stucco processing with the shape-retention stucco material. The shape-retention slurry formed by mixing the refractory particles containing 30% by mass of the fused silica particles and 70% by mass of the zirconium silicate particles was used therein. Mullite particles were used in the shape retention stucco material. Here, the casting molds of Examples 1 to 6 used the same shape-retention slurry and the same shape-retention stucco material. The refractory particles of #325 mesh size were used in the shape-retention slurry while the refractory particles of #100 mesh size were used in the shape-retention stucco material.

In each of the casting molds of Examples 1 to 3, the three-layered shape-retention slurry layer was formed on the weakening slurry layer by repeating the coating of the shape-retention slurry and the stucco processing with the shape-retention stucco material twice and then lastly performing the coating of the shape-retention slurry. In the casting mold of Example 4, the four-layered shape-retention slurry layer was formed on the weakening slurry layer by repeating the coating of the shape-retention slurry and the stucco processing with the shape-retention stucco material three times and then lastly performing the coating of the shape-retention slurry. In the casting mold of Example 5, the two-layered shape-retention slurry layer was formed on the weakening slurry layer by performing the coating of the shape-retention slurry and the stucco processing with the shape-retention stucco material once and then lastly performing the coating of the shape-retention slurry. In the casting mold of Example 6, the single-layered shape-retention slurry layer was formed on the weakening slurry layer by performing the coating of the shape-retention slurry.

Thus, the back-up slurry layer including the weakening slurry layer and the shape-retention slurry layer was formed on each reaction-resistant slurry layer.

Next, each wax pattern model provided with the reaction-resistant slurry layer and the back-up slurry layer was heated to 180° C. and dewaxed by using the autoclave, and was thereby formed into the casting mold compact (the green compact). After being dewaxed, the casting mold compact was burned in the burning furnace at 1100° C. for three to five hours, whereby the reaction-resistant slurry layer and the back-up slurry layer were sintered into the shell. Thus, the casting molds of Examples 1 to 6 were formed. Here, the same conditions of the dewaxing process and the same burning conditions were applied to the casting molds of Examples 1 to 6.

Next, methods of manufacturing casting molds of Comparative Examples 1 and 2 will be described.

In the casting mold of Comparative Example 1, the weakening slurry and the weakening stucco material are different from those of the casting molds of Examples 1 to 3. Instead of the weakening slurry of the casting molds of Examples 1 to 3, slurry formed by mixing refractory particles containing 70% by mass of the fused silica particles and 30% by mass of the zirconium silicate particles with colloidal silica was used in the casting mold of Comparative Example 1. Meanwhile, instead of the weakening stucco material of the casting molds of Examples 1 to 3, a stucco material formed by mixing 70% by mass of the fused silica particles with 30% by mass of the zirconium silicate particles was used in the casting mold of Comparative Example 1. Other features are the same as those of the methods of manufacturing the casting molds of Examples 1 to 3 and detailed description thereof will be omitted. The fused silica particles and the zirconium silicate particles of #325 mesh size were used for the slurry while those of #100 mesh size were used in the stucco material.

The casting mold of Comparative Example 2 is different from the casting molds of Examples 1 to 6 in that the weakening slurry layer is not formed therein. Specifically, in the casting mold of Comparative Example 2, slurry formed by mixing refractory particles containing 30% by mass of the fused silica particles and 70% by mass of the zirconium silicate particles with colloidal silica was coated on the reaction-resistant slurry layer, and then the stucco processing was performed thereon by using a stucco material made of the mullite particles. The five-layered slurry layer was formed by repeating the coating of this slurry and the stucco processing with this stucco material four times and then lastly performing the coating of this slurry. Meanwhile, regarding the casting mold of Comparative Example 2, the burning temperature after the dewaxing process was set to 1050° C. Other features are the same as those of the methods of manufacturing the casting molds of Examples 1 to 6 and detailed description thereof will be omitted. The fused silica particles and the zirconium silicate particles of #325 mesh size were used for the slurry while those of #100 mesh size were used in the stucco material. Note that the casting mold of Comparative Example 2 is the same casting mold as the conventional casting mold to cast a titanium alloy.

(High-Temperature Strength Characteristics of Casting Molds)

Figure 5:
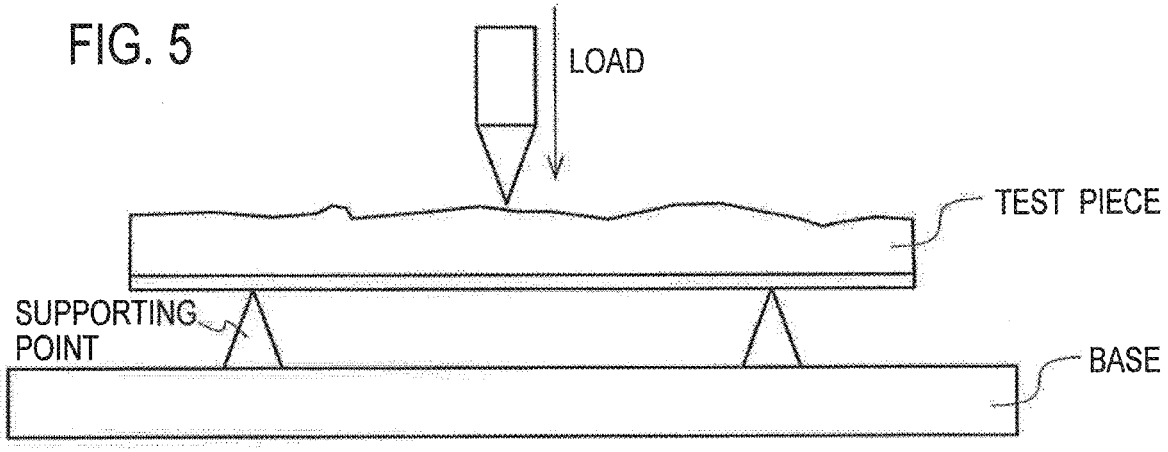
FIG. 5 is a diagram showing a method of testing strength of a casting mold in the embodiment of the present disclosure.

High-temperature strength characteristics of the casting molds of Examples 1 to 6 and Comparative Examples 1 and 2 were evaluated. Each test piece was formed by cutting it out of each casting mold. Regarding the shape of each test piece, the test piece was formed into a rectangular shape having the length of 40 mm (L)×the width of 15 mm (W)×the thickness of about 6 mm (t). FIG. 5 is a diagram showing a method of testing strength of the casting mold. The strength test was carried out in accordance with the ICI (Investment Casting Institute) Ceramics Testing Guidebook, and flexural strength (MPa) was measured therein. A span between supporting points was set to 40 mm, and a point angle of each supporting point was set to 2R. The strength test was carried out by applying a load to the test piece while heating and holding the test piece at a test temperature.

First, the high-temperature strength characteristics of the casting molds of Examples 1 to 3 and Comparative Examples 1 and 2 will be described. Regarding the test temperature, the casting molds of Examples 1 to 3 and Comparative Example 1 were tested in a range from 1000° C. to 1500° C. while the casting mold of Comparative Example 2 was tested in a range from a room temperature to 1400° C.

Figure 6:
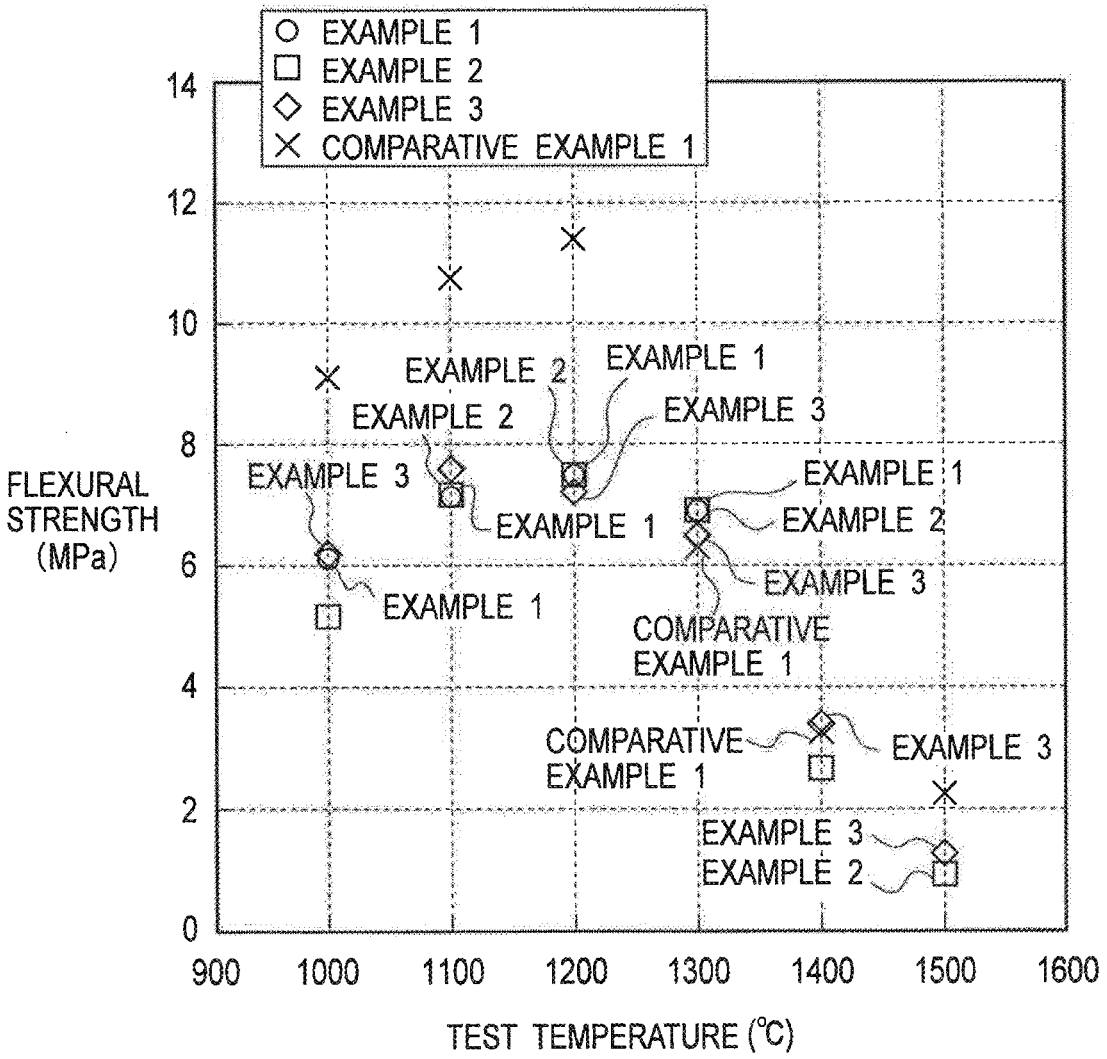
FIG. 6 is a graph showing high-temperature strength characteristics of casting molds of Examples 1 to 3 and Comparative Example 1 in the embodiment of the present disclosure.

FIG. 6 is a graph showing the high-temperature strength characteristics of the casting molds of Examples 1 to 3 and Comparative Example 1. In the graph of FIG. 6, the horizontal axis indicates the test temperature and the vertical axis indicates the flexural strength. The flexural strength of the casting mold of Example 1 is indicated with white circles. The flexural strength of the casting mold of Example 2 is indicated with white squares. The flexural strength of the casting mold of Example 3 is indicated with white rhombuses. The flexural strength of the casting mold of Comparative Example 1 is indicated with x.

In the temperature range from 1000° C. to 1100° C., the high-temperature strength of the casting mold of each of Examples 1 to 3 fell below the high-temperature strength of the casting mold of Comparative Example 1. Moreover, in the temperature range from 1000° C. to 1100° C., the high-temperature strength of the casting mold of each of Examples 1 and 2 fell even below the high-temperature strength of the casting mold of Example 3.

Figure 7:
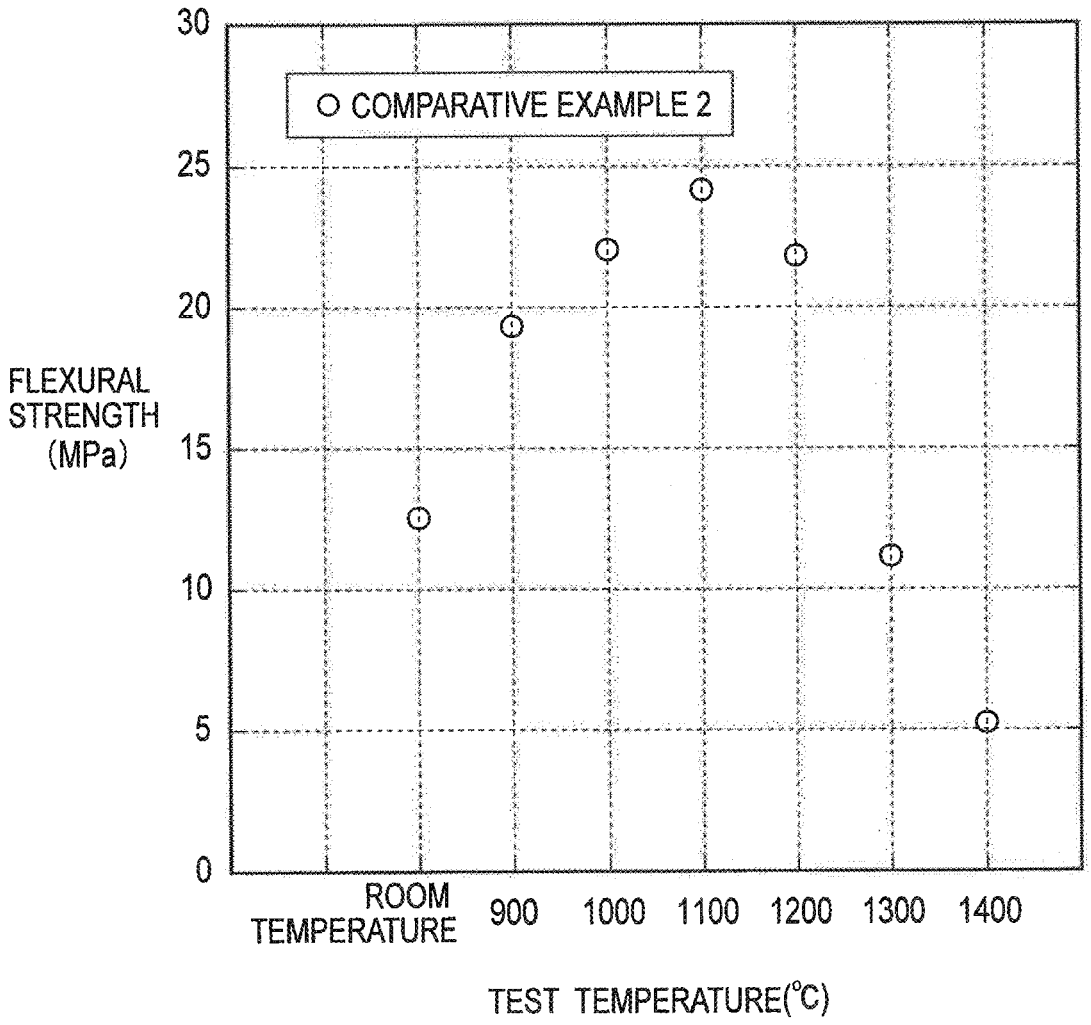
FIG. 7 is a graph showing high-temperature strength characteristics of a casting mold of Comparative Example 2 in the embodiment of the present disclosure.

FIG. 7 is a graph showing the high-temperature strength characteristics of the casting mold of Comparative Example 2. In the graph of FIG. 7, the horizontal axis indicates the test temperature and the vertical axis indicates the flexural strength. The flexural strength at each test temperature is indicated with a white circle. When the graph of FIG. 6 is compared with the graph of FIG. 7, the high-temperature strength of the casting mold of Comparative Example 2 was higher than the high-temperature strength of the casting mold of each of Examples 1 to 3 in the temperature range from 1000° C. to 1100° C. Thus, it was confirmed that the casting mold strength of the conventional casting mold to cast a titanium alloy was increased in a cooling process (from 1100° C. to 1000° C.) after casting a TiAl alloy cast product, and the casting mold was less likely to cause cracks.

Next, the high-temperature strength characteristics of the casting molds of Examples 1, 4, 5, and 6 will be described. The test temperature was set in a range from a room temperature to 1300° C.

Figure 8:
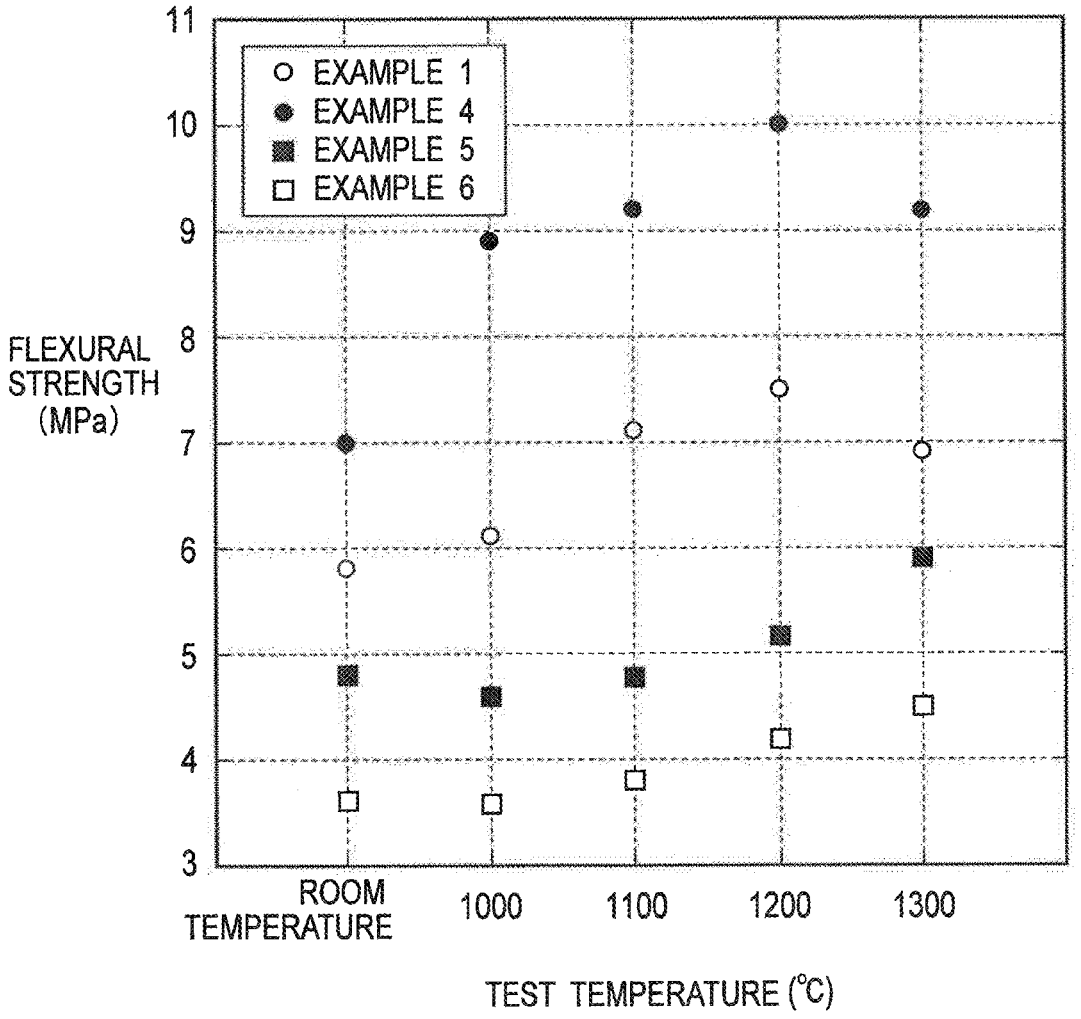
FIG. 8 is a graph showing high-temperature strength characteristics of casting molds of Examples 1, 4, 5, and 6 in the embodiment of the present disclosure.

FIG. 8 is a graph showing the high-temperature strength characteristics of the casting molds of Examples 1, 4, 5, and 6. In the graph of FIG. 8, the horizontal axis indicates the test temperature and the vertical axis indicates the flexural strength. The flexural strength of the casting mold of Example 1 is indicated with white circles. The flexural strength of the casting mold of Example 4 is indicated with black circles. The flexural strength of the casting mold of Example 5 is indicated with black squares. The flexural strength of the casting mold of Example 6 is indicated with white squares.

Regarding the casting mold strength, it was confirmed that the casting mold of Example 6 had the lowest strength and the casting mold of Example 4 had the highest strength at any test temperature, and that a relation of Example 6<Example 5<Example 1<Example 4 was applicable. This made it clear that the thinner weakening layer had the higher high-temperature strength and the thicker weakening layer had the lower high-temperature strength.

(Cross-Sectional Structure Observation of Casting Molds)

Figure 9A:
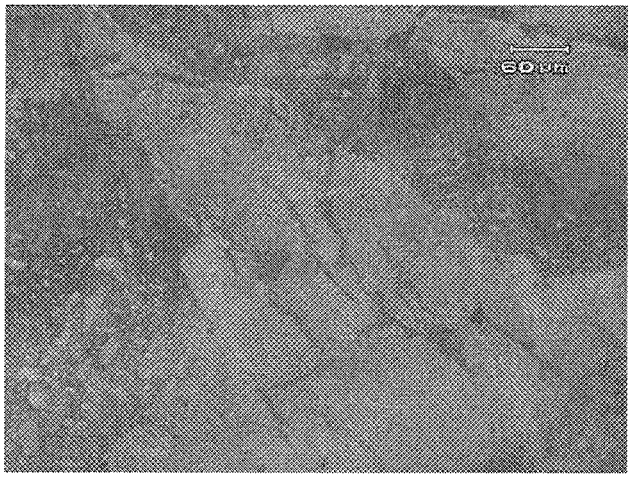
FIG. 9A is a photograph showing a result of cross-sectional structure observation of the casting mold of Comparative Example 1 in the embodiment of the present disclosure.
Figure 9B:
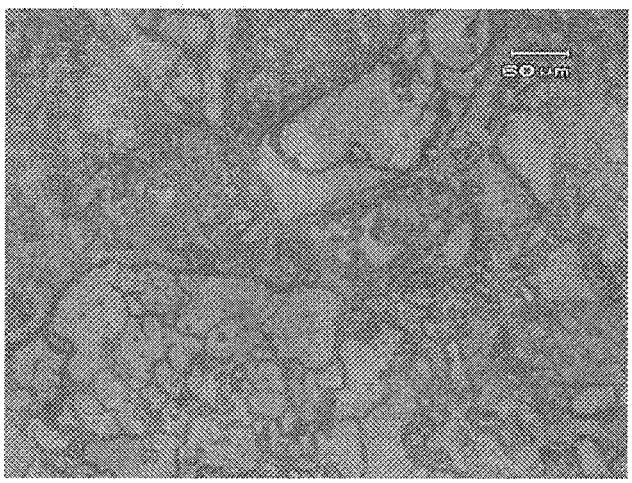
FIG. 9B is a photograph showing a result of cross-sectional structure observation of the casting mold of Example 2 in the embodiment of the present disclosure.

The casting molds of Example 2 and Comparative Example 1 before the strength test were subjected to cross-sectional structure observation with an optical microscope. FIGS. 9A and 9B include photographs showing a result of cross-sectional structure observation of the casting molds of Example 2 and Comparative Example 1. FIG. 9A is a photograph showing a result of cross-sectional structure observation of the casting mold of Comparative Example 1, and FIG. 9B is a photograph showing a result of cross-sectional structure observation of the casting mold of Example 2. Here, in the casting mold of Example 2, a region of the casting mold subjected to the cross-sectional structure observation is the weakening layer. Meanwhile, in the casting mold of Comparative Example 1, a region of the casting mold subjected to the cross-sectional structure observation is the layer formed from the refractory particles containing 70% by mass of the fused silica particles and 30% by mass of the zirconium silicate particles, which corresponds to the weakening layer of the casting mold of Example 2.

As clear from the photographs of FIG. 9A and FIG. 9B, the casting mold of Comparative Example 1 caused less cracks (microcracks) whereas the casting mold of Example 2 caused more cracks (microcracks).

(Influence of Burning Process)

The high-temperature strength characteristics of the green compact for the casting mold of Example 1 at the point after the dewaxing process and before the burning process were evaluated in order to evaluate an influence of the burning process after the dewaxing process. A test piece was formed by cutting it out of the green compact. The size of the test piece and the method of the strength test were arranged in accordance with the aforementioned ICI (Investment Casting Institute) Ceramics Testing Guidebook.

Figure 10:
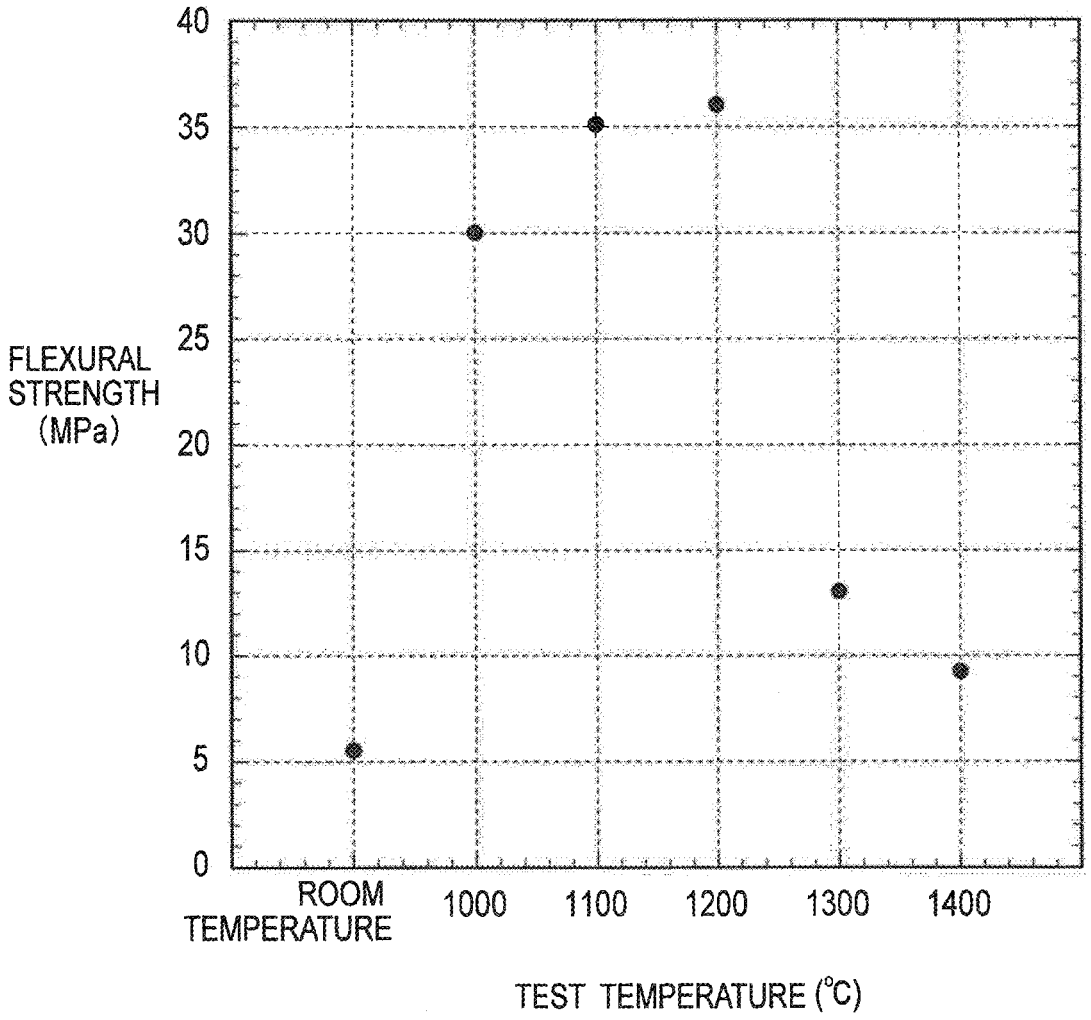
FIG. 10 is a graph showing high-temperature strength characteristics of a green compact in the embodiment of the present disclosure.

FIG. 10 is a graph showing the high-temperature strength characteristics of the green compact. In the graph of FIG. 10, the horizontal axis indicates the test temperature and the vertical axis indicates the flexural strength. The flexural strength at each test temperature is indicated with a black circle. When the high-temperature strength of the casting mold of Example 1 shown in FIG. 6 is compared with the high-temperature strength of the green compact shown in FIG. 10, the high-temperature strength of the green compact was higher in a temperature range from 1000° C. to 1200° C. Thus, it was made clear that the casting mold strength is reduced by the burning.

Silica casting molds made of fused silica were formed in order to evaluate a relation between the burning temperature and the amount of cristobalite in connection with the reduction in strength of the casting mold. First, a method of forming the silica casting molds will be described.

Silica slurry formed by mixing fused silica particles with colloidal silica was coated on each wax pattern model, and then stucco processing was performed with a silica stucco material formed from fused silica particles. As for the silica slurry and the silica stucco material, the same materials as those of the weakening slurry and the weakening stucco material of the casting mold of Example 1 were used, respectively.

A seven-layered silica slurry layer was formed by repeating the coating of the silica slurry and the stucco processing with the silica stucco material six times and then lastly performing the coating of the silica slurry. Next, the wax pattern models each provided with the silica slurry layer were subjected to the dewaxing process by heating the wax pattern models at 180° C. with an autoclave. After the dewaxing process, the wax pattern models were burned in a burning furnace at temperatures of 800° C., 900° C., 940° C., 970° C., 1000° C., 1050° C., and 1100°, respectively. Thus, the silica casting molds were formed by sintering the silica slurry layers into shells.

Next, the strength characteristics of the silica casting molds were evaluated. Test pieces were formed by cutting them out of the silica casting molds, respectively. The size of each test piece and the method of the strength test were arranged in accordance with the aforementioned ICI (Investment Casting Institute) Ceramics Testing Guidebook. Here, the strength tests were conducted at a room temperature.

Meanwhile, the silica casting molds burned at the various burning temperatures were subjected to quantification of the amount of cristobalite by measuring the rates of the amount of cristobalite in accordance with an X-ray diffraction method. The rate of the amount of cristobalite is a proportion of cristobalite with respect to a sum of fused silica and cristobalite. A horizontal sample mounting multipurpose X-ray diffraction system Ultima-IV manufactured by Rigaku Corporation was used as an X-ray diffraction system. The quantification of cristobalite was conducted in accordance with an internal standard method using silicon as a standard sample, and calibration curves for strengths of quartz and cristobalite formed in advance were used for calculation. The X-ray diffraction measurement was conducted by using a X-ray tube with a Cu target and under the following conditions, namely, an acceleration voltage at 40 kV, a current at 40 mA, a scan speed at 1 degree per minute, a measurement angle of cristobalite in a range from 21.0 degrees to 22.3 degrees, and a measurement angle of silicon in a range from 27.9 degrees to 29.0 degrees.

Figure 11:
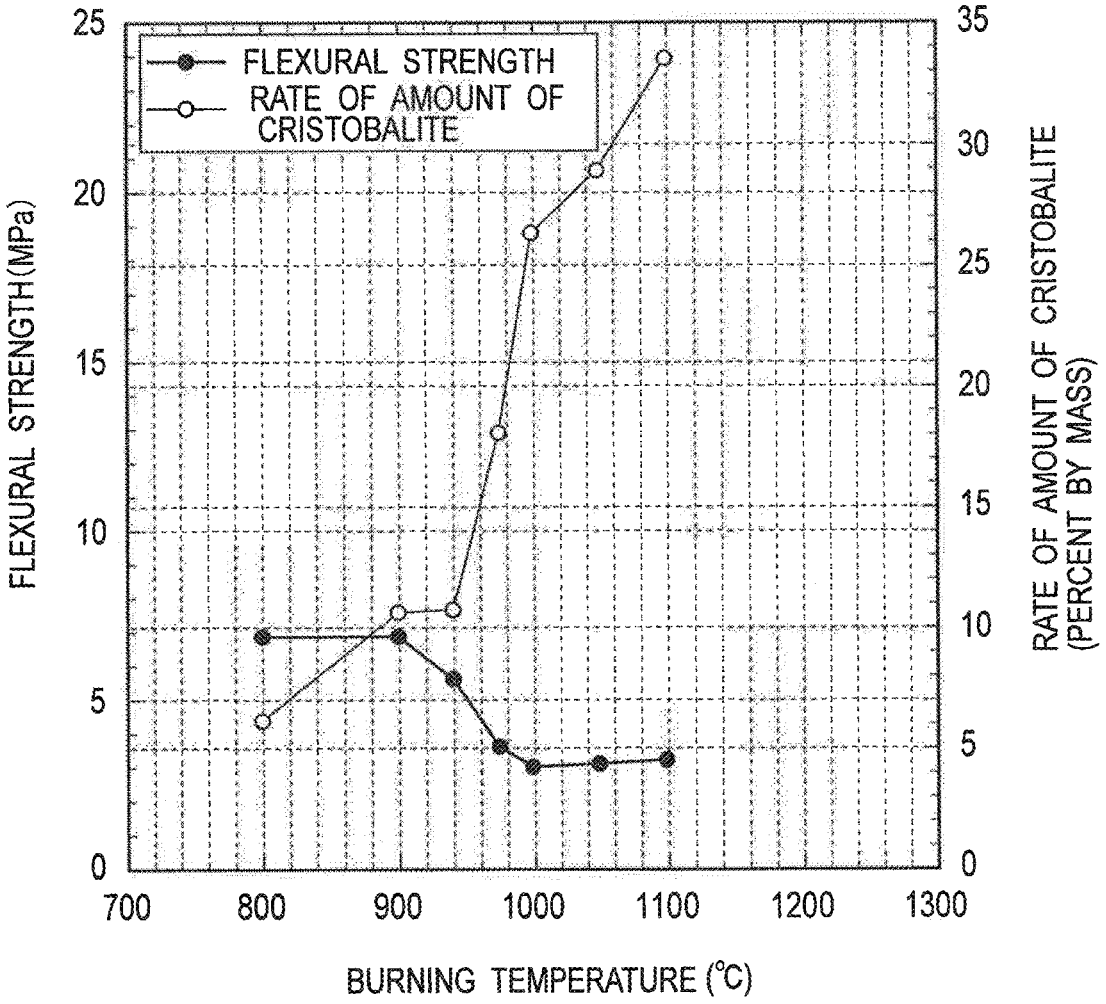
FIG. 11 is a graph showing a relation between room-temperature strength of a silica casting mold and a rate of an amount of cristobalite in the embodiment of the present disclosure.

FIG. 11 is a graph showing a relation between room-temperature strength of the silica casting mold and the rate of the amount of cristobalite. In the graph of FIG. 11, the horizontal axis indicates the burning temperature, the left vertical axis indicates the flexural strength, and the right vertical axis indicates the rate of the amount of cristobalite. The flexural strength is indicated with black circles while the rates of the amount of cristobalite are indicated with white circles.

It was confirmed that the strength of the silica casting mold started declining at the burning temperature of 900° C., and reached the lowest at the burning temperature in the range from 1000° C. to equal to or below 1100° C. As for the rates of the amount of cristobalite in the silica casting mold, the rates were equal to 11% by mass at the burning temperature of 900° C., 26% by mass at the burning temperature of 1000° C., and 34% by mass at the burning temperature of 1100° C., respectively. Accordingly, in terms of the relation between the strength of the silica casting mold and the rate of the amount of cristobalite, it was confirmed that the strength of the silica casting mold reached the lowest at the rate of the amount of cristobalite in the range from 26% by mass to 34% by mass inclusive.

(Evaluation of Crack Occurrence Rate)

Next, a turbine blade made of a TiAl alloy was cast by using the casting mold of Example 1, and a crack occurrence rate of the turbine blade was evaluated.

The casting mold of Example 1 and the casting mold of Comparative Example 2 were used as the casting molds to cast the turbine blade. A TiAl alloy having the composition of Ti-48 at % Al-2 at % Nb-2 at % Cr was used as the TiAl alloy. As for the size of the turbine blade, a length in its longitudinal direction was set to about 250 mm, a length in its width direction was set to about 60 mm, and its thickness was set to about 6 mm. The TiAl alloy put into the melting crucible in the melting chamber of the melting furnace was melted in vacuum, and the molten TiAl alloy was held at a prescribed temperature. The casting molds preheated to the temperature in the range from 1100° C. to 1300° C. were put into the casting mold chamber of the melting furnace and were evacuated. When the casting mold chamber reached a vacuum atmosphere equivalent to that of the melting chamber, the gate valve between the casting mold chamber and the melting chamber was opened and the casting molds were moved into the melting chamber. The molten TiAl alloy was poured into the casting molds while tilting the melting crucible. Meanwhile, the casting temperature was set in the range from 30° C. above to 160° C. above the melting point of the TiAl alloy.

Next, the casting molds into which the molten TiAl alloy was poured were moved to the casting mold chamber. The casting molds moved to the casting mold chamber were let stand for about 20 minutes in vacuum. Having let the casting molds stand, the casting mold chamber was opened to the atmosphere. Then, the casting molds in which the TiAl alloy was cast were taken out. The casting molds were loaded on the wagon and were let stand until the casting molds were cooled down to a room temperature. In the meantime, surface temperatures of the casting molds were measured with an infrared camera.

One hundred turbine blades were cast each by using the casting molds of Example 1 and Comparative Example 2, and then the crack occurrence rates were obtained. The rates were 82% in the case of the casting mold of Comparative Example 2, and 50% in the case of the casting mold of Example 1. Thus, by providing the casting mold with the weakening layer, the crack occurrence rate was successfully reduced by 32%. Here, regarding the turbine blades that caused cracks, each turbine blade caused the cracks when the surface temperature of the corresponding casting mold was in the range from 1100° C. to 1000° C. in the cooling process after the casting.

The present disclosure can suppress fractures or cracks in TiAl alloy cast products, and are therefore useful for casting TiAl alloy cast products such as turbine blades.

What is claimed:

1. A casting mold to cast a TiAl alloy, comprising:

a casting mold body formed into a bottomed shape and provided with a cavity into which a molten TiAl alloy is to be poured, wherein the casting mold body includes a reaction-resistant layer provided on the cavity side, formed from a refractory material containing at least one of cerium oxide, yttrium oxide, and zirconium oxide, and configured to suppress a reaction with the molten TiAl alloy, and a back-up layer formed on the reaction-resistant layer, and the back-up layer includes a weakening layer formed from a refractory material including a silica material in a range from 80% by mass to 100% by mass inclusive, the silica material containing cristobalite in a range from 26% by mass to 34% by mass inclusive and the rest being fused silica, the weakening layer being designed to reduce casting mold strength so that cracks occur on the casting mold in a cooling process from 1100° C. to 1000° C. after casting, and a shape-retention layer formed from a refractory material and designed to retain a casting mold shape, and the casting mold flexural strength at to 1100° C. is in a range from 3.8 MPa to 9.2 MPa inclusive.

2. The casting mold according to claim 1, wherein the refractory material forming the weakening layer includes the silica material in a range from 90% by mass to 100% by mass inclusive.

3. The casting mold according to claim 1, wherein the weakening layer is formed directly on the reaction-resistant layer.

4. The casting mold according to claim 1, wherein the casting mold body includes:

a blade body casting portion to cast a blade body;

a shroud casting portion to cast a shroud; and a platform casting portion to cast a platform.

5. The casting mold according to claim 2, wherein the refractory material forming the weakening layer consists of the silica material.

* * * * *